United States Patent [19]

Watanabe et al.

[11] 4,370,943

[45] Feb. 1, 1983

[54] APPARATUS FOR PAINTING CONTAINERS

[75] Inventors: Kazutomi Watanabe; Sokichi Iwasaki; Nobuyuki Baba, all of Sakai, Japan

[73] Assignee: Shin Nippon Koki Co., Ltd., Osaka, Japan

[21] Appl. No.: 218,192

[22] Filed: Dec. 19, 1980

[30] Foreign Application Priority Data

Dec. 22, 1979 [JP] Japan ..... 54-166297

[51] Int. Cl.[3] ..... B05C 1/00

[52] U.S. Cl. ..... 118/218; 118/220; 118/223; 118/230; 118/233; 118/224; 118/262

[58] Field of Search ..... 118/218, 219, 220, 223, 118/224, 230, 232, 233, 262, 46, DIG. 3, 255; 427/428; 113/120 A; 101/38 A, 38 R, 39, 40

[56] References Cited

U.S. PATENT DOCUMENTS

| | | | |
|---|---|---|---|
| 2,112,246 | 3/1938 | Maher | 118/262 X |
| 2,944,510 | 7/1960 | Jeremiah | 118/233 |
| 3,356,019 | 12/1967 | Zurick . | |
| 3,521,554 | 7/1970 | Zurick . | |
| 3,616,778 | 11/1971 | Sirvet et al. | 118/262 |
| 3,665,853 | 5/1972 | Hartmeister et al. . | |
| 3,766,851 | 10/1973 | Sirvet et al. . | |
| 3,996,851 | 12/1976 | Urban | 101/40 |
| 4,271,216 | 6/1981 | Shimizu | 427/428 |

*Primary Examiner*—Bernard F. Plantz
*Attorney, Agent, or Firm*—Spencer & Kaye

[57] ABSTRACT

An apparatus for painting the outer circumferential surfaces of a plurality of cylindrical containers. The apparatus comprises a rotatable disc having a surface positioned in a vertical plane and a plurality of mandrels secured to the surface of the disc and projecting horizontally therefrom for supporting the containers. A rotatable painting roll is positioned adjacent the disc for applying paint to the containers. First and second rotatable paint storage rolls are provided, the second paint storage roll being above said painting roll and interposed between the painting roll and the first paint storage roll. The axes of the two paint storage rolls are parallel and in a horizontal plane, and the axes of the painting roll and the second storage roll are parallel and define a plane which is angularly displaced with respect to the horizontal and vertical planes.

11 Claims, 21 Drawing Figures

APPARATUS FOR PAINTING CONTAINERS

BACKGROUND OF THE INVENTION

The present invention relates to an improved apparatus for painting the outer circumferential surface of a can or container. The terms "can" and "container" are used interchangeably herein to designate a hollow preformed body generally, but not necessarily, of cylindrical shape.

Conventional apparatus for painting the cylindrical surface of the body of a cylindrical can or container generally comprises, as shown in FIG. 1, a container transporting unit A including a rotatable disc 1 having a surface disposed in a vertical plane, and a plurality of rotatable mandrels 3 extending horizontally outward at right angles from the surface of the disc. The mandrels are spaced at equal intervals with respect to each other along a concentric circle adjacent the outer periphery 2 of the rotatable disc 1.

The painting unit B is equipped with a painting roll 11 for contacting the cylindrical body surfaces of containers C (shown by dahsed lines), each of the containers being releasably supported on a mandrel 3. The painting unit also includes first and second paint storage rolls 13 and 12 respectively, the first and second paint storage rolls cooperating with each other to hold paint therebetween. In FIG. 1, numeral 14 designates a paint reservoir located between the paint storage rolls and numeral 15 designates a pipe for supplying paint to the reservoir.

In this conventional painting apparatus, a plurality of blank containers C supplied through a guide way (not shown) drop into position on the mandrels 3. The mandrels 3 are carried along the outer circumference of the rotatable disc 1 so that the containers C may be placed, one after another, in position on corresponding mandrels, the mandrels 3 moving with a rotating motion along a circular path 5 having its center coincident with the axis of disc 1. When the mandrels reach a painting zone 6 they are shifted to a circular path which is concentric with the outer peripheral edge 16 of painting roll 11, portions of the outer edge 16 of the painting roll 11 sequentially coming into contact in painting zone 6 with the outer cylindrical surfaces of the containers C.

While passing through the painting zone 6, the series of containers placed on the mandrels 3 have their outer cylindrical surfaces contacted with a rotating motion by the outer circumference of the painting roll during at least one rotating motion of the cylindrical surface of each of the containers. The paint held on the outer circumference 16 of the painting roll is transferred to the container during this rotation. Thus, painted containers are fed in rotation along the path of motion during which travel they are withdrawn from the mandrels 3, and then delivered to a drying oven (not shown).

Details of the arrangement described above whereby the path of the mandrels and the containers is shifted from being concentric with the axis of rotatable disc 1 to being concentric with the axis of painting roll 11 in the painting zone 6 are disclosed in U.S. Pat. No. 3,356,019.

Another arrangement is disclosed in Japanese Patent Publication No. 18,723/1974 wherein, in contrast with the path imposed on the containers in the painting zone of the apparatus described in U.S. Pat. No. 3,356,019, the containers continue to travel in the painting zone along a concentric circular path of motion with respect to the center of the rotatable disc. In this prior art apparatus, the circumferential area of the painting roll is shifted to conform to the circular path of motion of the containers.

Because the known painting apparatus provides only a single painting zone, it is not possible to apply paint to the cylindrical body portion of the containers more than once. Also, when the angular speed of the painting roll is increased for the purpose of increasing the number of containers to be painted in a given amount of time, the paint held on the outer circumference of the painting roll tends to be thrown outward or spun away thereby resulting in possible stains or contamination by the paint on parts of the containers, the mandrels and surrounding surfaces.

The present invention is directed to the provision of an improved painting apparatus which effectively overcomes the disadvantages stated above.

SUMMARY OF THE INVENTION

The painting apparatus according to this invention provides painting units at two different positions along the circular path of motion of the containers for the purpose of obviating the disadvantages of the prior art. The apparatus is relatively small and compact despite the use of two painting units disposed at different positions. Further, the painting roll and the first and second paint storage rolls are driven independently of each other, and the angular speed of each of the rolls may be changed independently of each other. In this way, the quantity of paint applied to the containers may be varied over a relatively wide range.

In addition, the painting apparatus in equipped with devices that enable the painting roll, the first paint storage roll and a set consisting of the first and second paint storage rolls to be independently adjustably displaced with respect to each other. A device is also provided for quickly breaking the contact between the lower painting roll and the cylindrical body surface of a container being painted so as to separate the two without movement of the lower painting roll thereby making it possible to readily adjust and measure the quantity of paint being applied.

Further provided is a device which permits a quick separating movement of the first paint storage roll from the second paint storage roll in order to prevent damage to the outer circumferential surfaces of both paint storage rolls in the event they are rotated when neither roller is being supplied with paint, as may occur, for example, as the result of an operating error.

Moreover, the apparatus is provided with a group of elements at the rear bearing of the first paint storage roll shaft which allows a fine adjustment of the location of the rear bearing with respect to the second paint storage roll shaft. This makes it possible to achieve positive parallelism between the opposed outer circumferential surfaces of both paint storage rolls when they are being urged toward each other.

In addition, the painting apparatus is provided with a stopper device for stopping the rotating motion of the mandrels disposed in the path of motion of the containers behind the lower painting roll. As a result, the containers may be removed one-by-one from the mandrels.

DESCRIPTION OF THE PREFERRED EMBODIMENT

Figure 1:
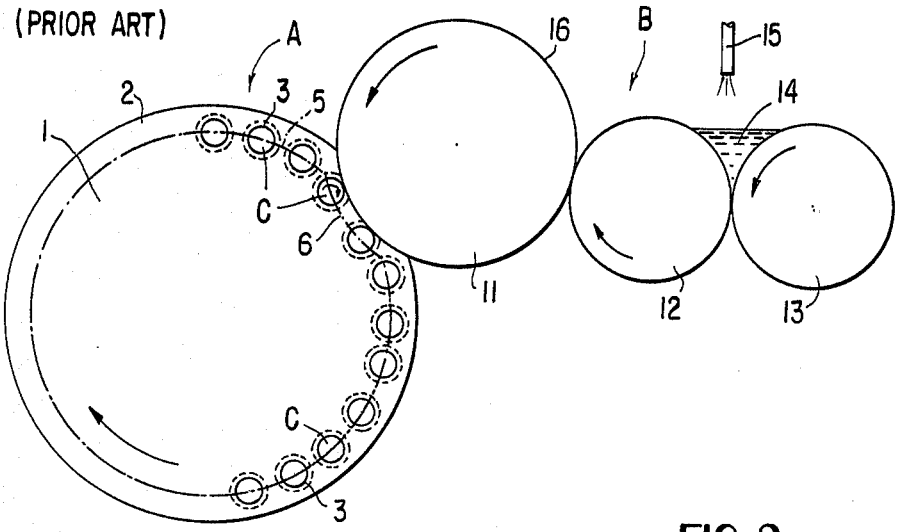
FIG. 1 (PRIOR ART)
FIG. 1 is a schematic diagram illustrating the general construction of a conventional can painting apparatus.
Figure 2:
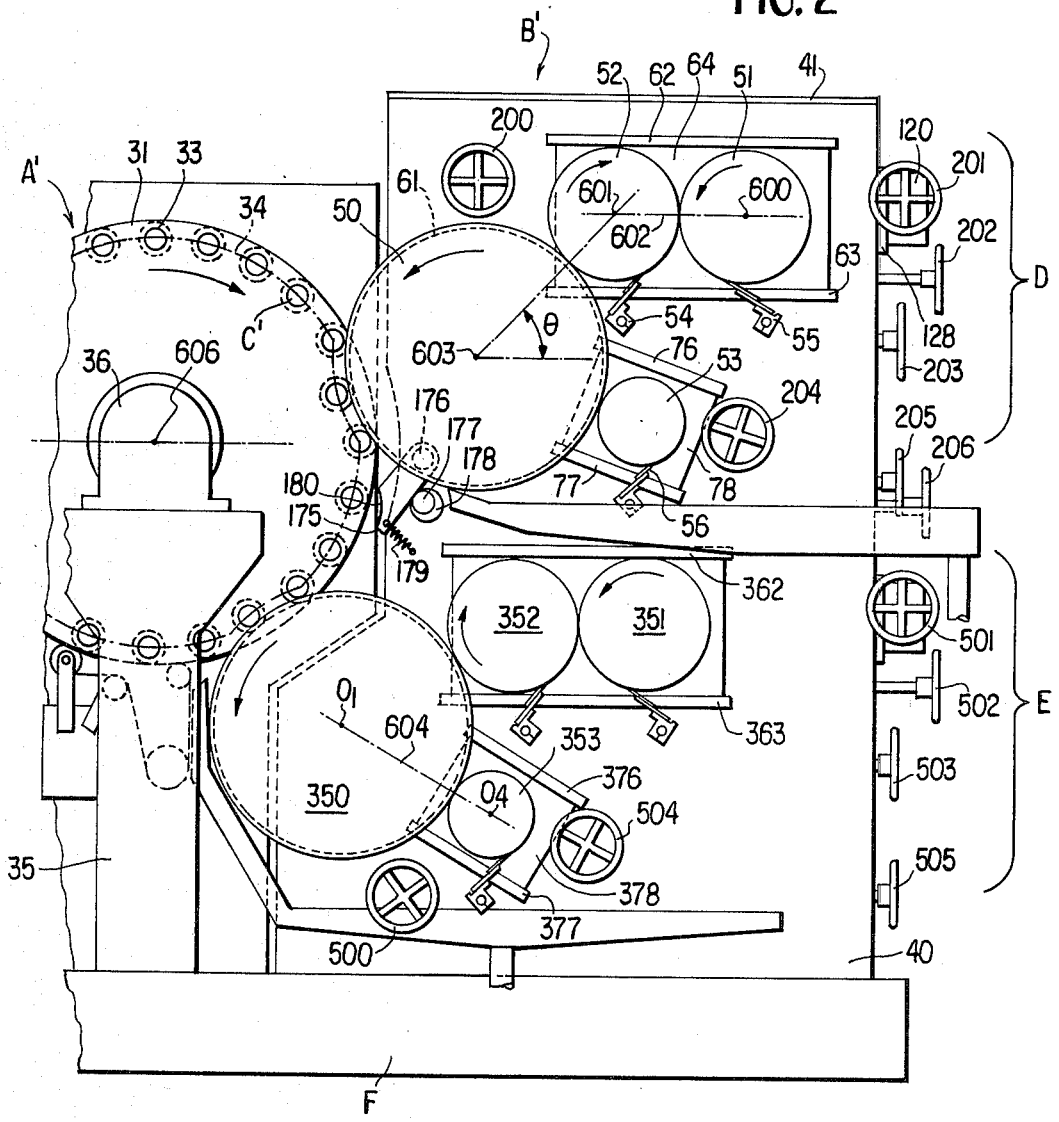
FIG. 2 is a front elevational view showing a preferred embodiment of the container painting apparatus according to this invention.
Figure 3:
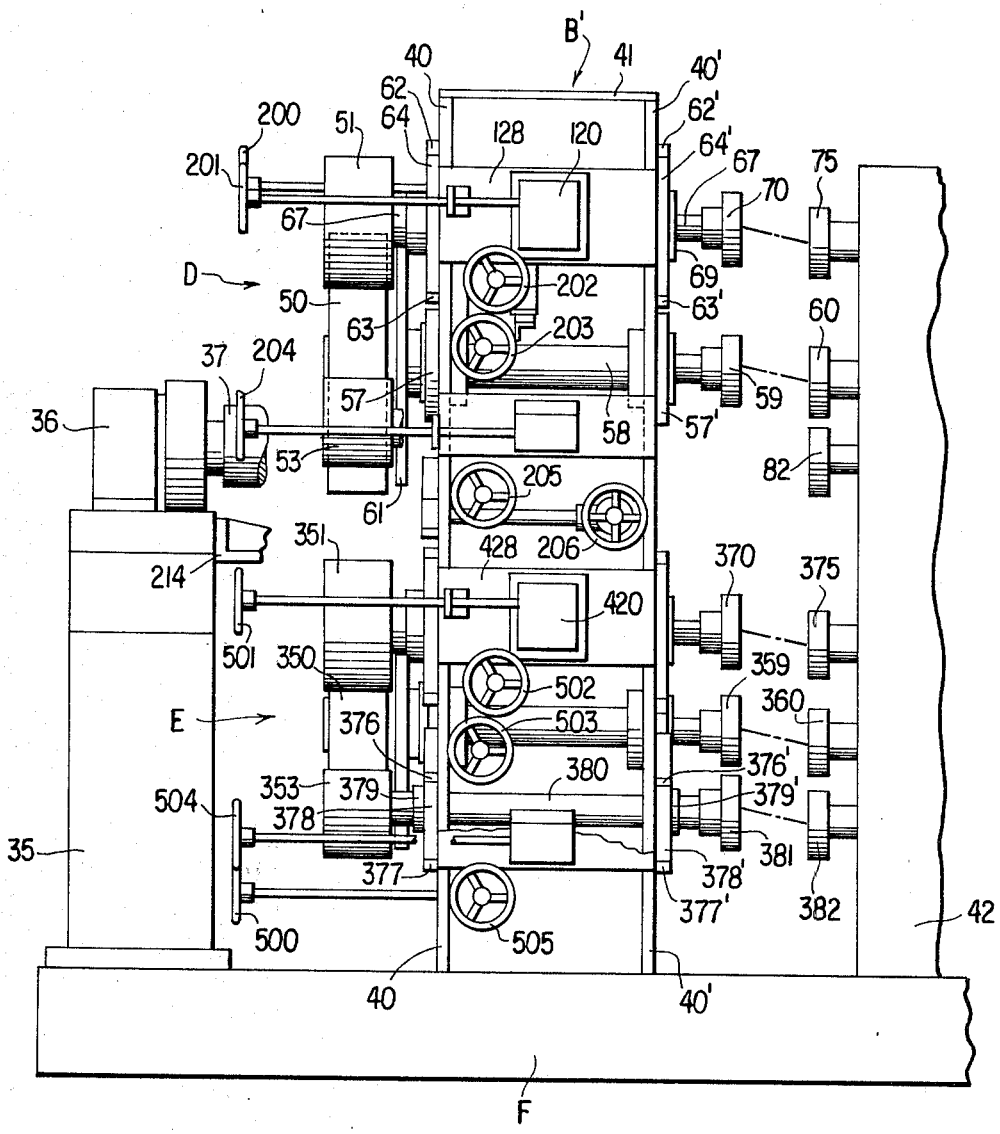
FIG. 3 is a side elevational view showing the apparatus of the invention.
Figure 4:
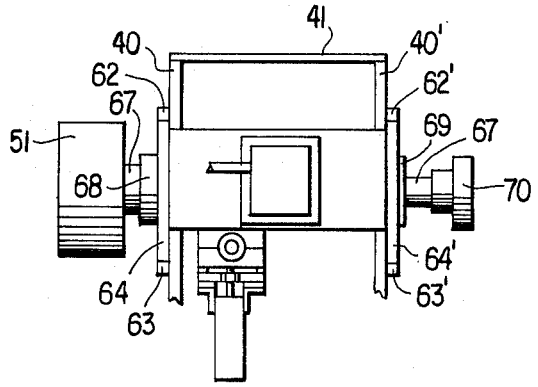
FIG. 4 is a side elevational view showing the paint storage means including first and second paint storage rolls.

Referring to FIGS. 2 and 3 showing front and side elevational views respectively of the preferred embodiment of the invention, the reference character A′ designates a container transporting device, B′ a painting device assembly, C′ each of a plurality of containers, D an upper painting device, E a lower painting device and F a base plate. The container transporting device A′, which is of the same construction as the conventional arrangement shown in FIG. 1, comprises a rotatable disc 31 having a surface positioned in a vertical plane and a plurality of mandrels 33 corresponding to the rotatable disc 1 and the series of mandrels 3 respectively of the conventional container transporting unit A shown in FIG. 1. The rotatable disc 31 is mounted on a horizontal shaft 37 journalled in a shaft bearing 36 supported by an upright pedestal or bearing stand 35 securely mounted to the base plate F. For clarity, the disc 31 and mandrels 33 are omitted from FIG. 3.

The painting device assembly B′ comprises a pair of upright plates 40 and 40′ mounted securely upon the base plate F adjacent the can transport device and parallel to the rotatable disc 31, a top plate 41 extending across the upper ends of the pair of upright plates 40 and 40′, an upper painting device D, a lower painting device E and a gear box 42 including electric motors (not shown).

The upper and lower painting devices D and E are of similar construction differing only in the mounting positions of a series of fine adjustment hand wheels. The upper painting device D comprises, as shown in FIG. 2, a painting roll 50 disposed diagonally adjacent the rotatable disc 31 with its axis of rotation at a slightly higher position than the axis of rotation of disc 31 so as to contact the containers travelling on the path 34, a second paint storage roll 52 disposed diagonally adjacent and at a slightly higher position than the painting roll 50 so as to operatively contact roll 50, a first paint storage roll 51 disposed horizontally adjacent the second paint storage roll 52 so as to operatively contact roll 52, a scraper roll 53 disposed adjacent roll 50 at a lower position so as to operatively contact the painting roll, and scraping members 54, 55 and 56 disposed engageably with the second and first paint storage rolls 52, 51 and the scraper roll 53, respectively.

More specifically, the axes of rotation 600 and 601 of paint storage rolls 51 and 52 respectively are parallel and define a horizontal plane perpendicular to the plane of FIG. 2, as indicated by dashed line 602. The axis of rotation 603 of the painting roll 50 is parallel to axis 601 of storage roll 52 and these axes defines a plane which is angularly displaced by the angle $\theta$ with respect to the horizontal plane, axis 601 being displaced upward and to the right in FIG. 2 from axis 603. The axis 603 is displaced vertically from the horizontal plane containing the axis 606 about which the rotatable disc 31 rotates.

Paint is supplied by a pipe (not shown) to a reservoir between paint storage rolls 51 and 52 in the same manner as in the prior art apparatus of FIG. 1.

Referring to FIG. 3, the painting roll 50 is securely mounted on one end of a shaft 58 centered on axis 603 and held horizontally by bearings 57 and 57′ disposed in the upright parallel plates 40 and 40′, respectively. At the opposite end of the shaft 58, there is securely mounted a coupling 59 connected through a universal joint (not shown) to another coupling 60 mounted rigidly on a rotating shaft projecting outwardly from the gear box 42.

A disc 61 having a smaller diameter than the painting roll 50 is mounted on the shaft 58 adjacent the painting roll 50 and between this roll and the upright plate 40 in such a manner that is rotatably contacts an enlarged roller 160 (see FIGS. 11 and 12) associated with each mandrel for the purpose of assisting rotation of the mandrels.

Figure 5:
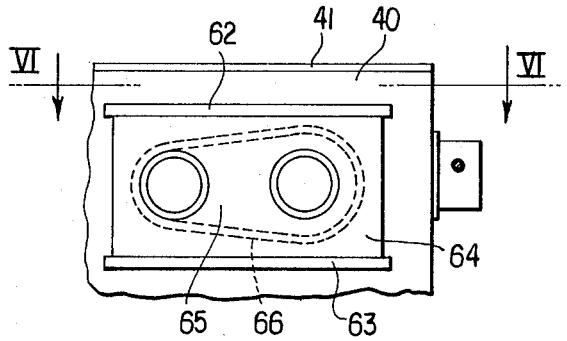
FIG. 5 is a front elevational view showing the paint storage means.

A paint storage means including the first paint storage roll 51 and the second paint storage roll 52 comprises, as shown in FIGS. 2–6 pairs of upper and lower guide frames 62, 63 and 62′, 63′ extending horizontally parallel to each other and secured respectively on the outer surfaces of the upright plates 40, 40′, slide plate members 64, 64′ held slidably in the horizontal direction between the pairs of upper and lower guide frames, respectively, and a connecting member 66 having both ends connected to slide plate members 64 and 64' and defining with the slide members a space 65 (see FIG. 5). A first front bearing 68 is provided in the slide plate member 64 and a first rear bearing 69 is provided in the slide plate member 64', a shaft 67 extending within the space 65 being held rotatably within these bearings. On the end of shaft 67 on the side supported by the first front bearing 68, there is securely mounted the first paint storage roll 51, and on the end of the shaft supported by the first rear bearing 69 there is securely mounted a coupling 70. Further, a second front bearing 71 and a second rear bearing 72 are provided rigidly in the slide plate members 64 and 64', respectively, through which bearings a rotatable shaft 74 extends rotatably in parallel with the shaft 67 within the space 65. On the end of shaft 74 supported by the second front bearing 71, there is mounted rigidly the second paint storage roll 52, a coupling 73 being mounted rigidly on the end thereof supported by the second rear bearing 72. Referring to FIG. 3, the coupling 70 which is securely mounted on the end of the first roll shaft 67 is operatively connected through a universal joint (not shown) to a coupling 75 projecting from the gear box 42, and the coupling 73 rigidly mounted on the end of the second roll shaft 74 is likewise connected to another coupling (not shown) projecting from the gear box.

The principal members of the lower painting device E which correspond to those of the upper painting device D are designated by numerals which are equal to 300 more than the numerals designating the corresponding parts in the upper painting device, as shown in FIGS. 2 and 3. For example, painting roll 350 in the lower painting device E corresponds to painting roll 50 in the upper painting device D. The scraper rolls 53 and 353 scrape off the paint remaining on the painting rolls 50 and 350 after painting the cylindrical body of a container without damaging the circumferential surfaces of the roll. As the suspension of the scraper rolls is common to both the upper and lower painting devices D and E, this feature of the lower painting device only will be described.

Referring to FIGS. 2 and 3, a scraper roll shaft 380 is mounted rotatably through a front bearing 379 secured rigidly in a slide plate 378 disposed slidably between upper and lower guide frames 376 and 377. The guide frames 376, and 377 are securely mounted on the outer surface of the upright plate 40 parallel to a straight dashed line 604 defined by the center $0_4$ of the scraper roll 353 and the center $0_1$ of the lower painting roll 350. A rear bearing 379' is mounted rigidly in a slide plate 378' disposed slidably between upper and lower guide frames 376' and 377' and on the outer surface of the opposite upright plate 40'. The scraper roll 353 is secured to the end of scraper roll shaft 380 on the side adjacent the front bearing 379. On the opposite end of shaft 380 adjacent the rear bearing 379', there is securely mounted a coupling 381, which coupling 381 is connected through a universal joint (not shown) to a coupling 382 projecting from the gear box.

The upper and lower painting devices D and E each include a first fine adjusting unit for moving the painting roll toward or away from the transport path of the containers, a second fine adjusting unit for shifting both the first and second paint storage rolls as a set to adjust the engaging force between the painting roll and the second paint storage roll, a third fine adjusting unit for adjusting the gap between the first and second paint storage rolls, a fourth quick adjusting unit for separating the first paint storage roll from the second paint storage roll in a quick motion, a fifth fine adjusting unit for adjusting the gap between the painting roll and the scraper roll and a sixth fine adjusting unit located at the rear bearing of the first paint storage roll shaft for correcting any deviation from parallelism between the outer circumferential surfaces of the first and second paint storage rolls when urging the first paint storage roll against the second paint storage roll.

The third fine adjusting unit will be described first in conjunction with FIGS. 7, 8 and 9. In the upper left of FIG. 7, there are shown the connecting member 66 in the paint storage means, the second roll shaft 74 and the first roll shaft 67 extending perpendicular to the plane of the figure through the connecting member 66. Also, an eccentric ring 91 surrounds the first roll shaft 67 in such a manner that its outer circular surface has a center $0_2'$ offset from the center $0_2$ of the first roll shaft 67 and an inner circular surface having the center $0_2$, ring 91 being surrounded by an outer annular member 90 fixed to the connecting member 66 by means not shown in the drawing. The ring 91 is rotatable within the inner surface of the fixed outer annular member 90, and the first roll shaft 67 is rotatable within the inner surface of the ring 91.

An arm 92 depending downwardly from the ring 91 through an opening 118 in the fixed outer annular member 90 is provided for rotating arm ring 91, arm 92 being connected to a first connecting rod 94. The first connecting rod 94 is coupled to a second connecting rod 96 and the second connecting rod 96 is coupled in the horizontal direction to a slide 98. When slide 98 is moved in the horizontal direction, (for instance, when it is shifted to the left as viewed in FIG. 7), the ring 91 is rotated in the clockwise direction. The slide 98 is held slidably in the horizontal direction by a lower part 102 of a support block 101 and holding plates 117, 117' secured to the side of the connecting member 66, the slide 98 having a screw rod 99 extending horizontally in the direction away from the second connecting rod 96. The screw rod 99 is threadedly rotatably engaged with the leading end 106 of a horizontal shaft 100 of a hand wheel 202. Also, a lock plate 104 is fixed to the right end wall 103 of the support block 101 which is rigidly connected to the connecting member 66, the leading end 106 of the horizontal shaft 100 being rotatably supported by and between the lock plate 104 and a sandwich block 105. When not being used to effect the third fine adjusting procedure, the shaft 100 is secured to the lock plate 104 by a lock screw 108 extending vertically through the sandwich block 105. The numeral 107 designates a stopper ring for preventing the leading end 106 of shaft 100 from moving in the horizontal direction with respect to the lock plate 104.

Figure 7:
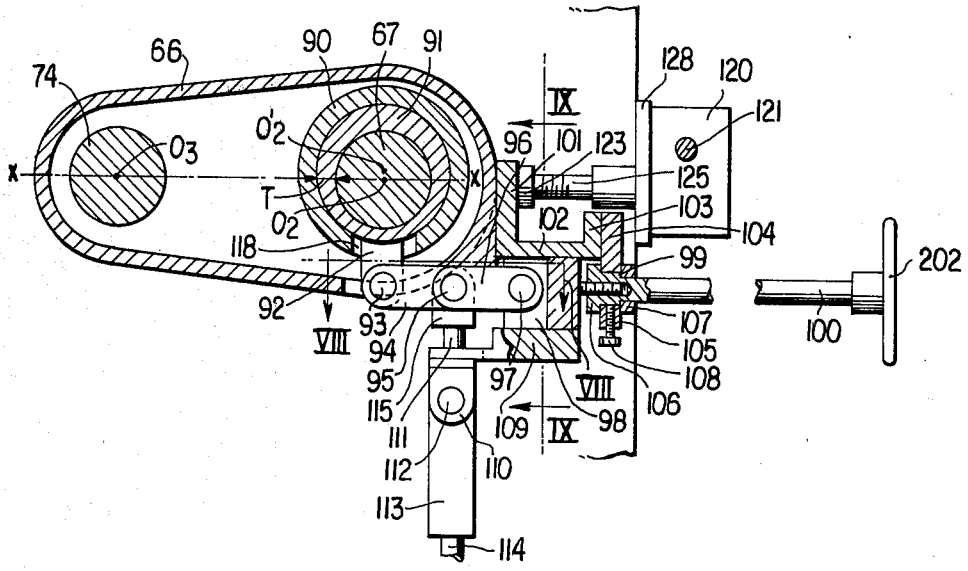
FIG. 7 is an enlarged cross-sectional view taken along the line VII—VII in FIG. 6.
Figure 8:
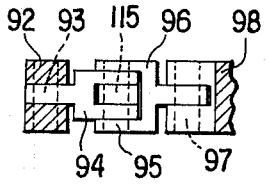
FIG. 8 is a view seen along the line VIII—VIII in FIG. 7.
Figure 9:
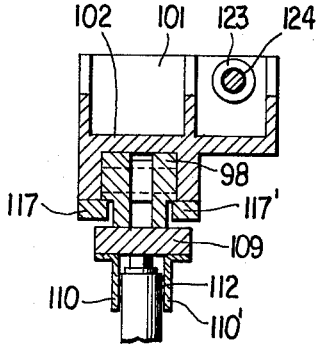
FIG. 9 is a cross-sectional view taken along the line IX—IX in FIG. 7.

Referring to FIGS. 7 and 8, specifically, the arm 92 is connected rotatably to the first connecting rod 94 by a pin 93, the first connecting rod 94 being mutually rotatably connected to the second connecting rod 96 and the second connecting rod 96 being in turn connected rotatably with respect to the slide 98 through a pin 97. A pin 95 is inserted into a bifurcated part of the first connecting rod 94, the second connecting rod 96 having a bifurcated part which rides externally over the bifurcated part of the first connecting rod. An upper end 115 of a rod 111 connected to a piston (not shown) within an air cylinder 113 is snugly inserted into the bifurcated part of rod 94. As shown in FIGS. 7 and 9, the cylinder 113 is connected to a mount plate 109 fixed at the lower end of the slide 98, and is further mounted pivotally by depending plates 110, 110' from the mount plate 109 by a pin 112. The numeral 114 designates a pipe for actuating the air cylinder by using positive or negative pneumatic pressure.

A fine adjustment of the gap or mutually urging contact relationship between the first and second paint storage rolls 51 and 52 is made by manually rotating the hand wheel 202. With a single turn of the hand wheel 202, the leading end portion 106 of the shaft 100 is caused to rotate through one turn while being held in the same axial position; therefore, the screw rod 99 fixed to the slide 98 which is held slidably in the horizontal direction is fed by one pitch of the threads thereof toward or away from the leading end portion 106 of the shaft 100. Since the air cylinder 113 is not normally actuated, and the first connecting rod 94 and the second connecting rod 96 are held in a straight and horizontal position, the feeding motion of the screw rod 99 is immediately transmitted to the arm 92 in such a manner that the arm is caused to rotate to the left or right about the center $0_2'$ through a distance corresponding to one pitch of the threads. With this motion, the eccentric inner surface of the ring 91 is shifted with respect to the fixed outer annular member 90 thereby shifting the axial direction of the first roll shaft 67, accordingly.

For example, when the arm 92 is rotated to the left (clockwise) in FIG. 7, the center $0_2$ of the first roll shaft 67 describes an arcuate path of travel having a radius of $(0_2'-0_2)$ about the center $0_2'$. Since the amount of this travel is very small, the axis of shaft 67 shifts to a point approximately on the linear segment x—x passing through the center $0_3$ of the second roll shaft 74. As a result of this shifting motion, the width or thickness T of the ring 91 along the x—x axis becomes smaller than before it was rotated causing the first roll shaft 67 to approach the second roll shaft 74. That is, the first paint storage roll and the second paint storage roll are caused to approach each other. In the preferred embodiment shown, the first roll shaft 67 shifts a distance of 0.08 mm in the horizontal direction with a single rotating motion of the hand wheel 202, the described eccentric arrangement making it possible to obtain an accurate fine adjustment.

Next, referring particularly to FIG. 7, the fourth adjusting means for separating the first paint storage roll from the second paint storage roll in a quick motion and by a relatively large amount will be described.

After the axial adjustment between the first and second paint storage rolls discussed above has been completed, the shaft 100 of the hand wheel is fixed rigidly in position by tightening lock screw 108 to prevent further rotation. However, if both paint storage rolls are kept running after the paint supply to both rolls has stopped, the roll surfaces may be damaged from seizure because the rolls are being positively urged toward each other. Should this occur, damage is unlikely to be prevented by merely turning the hand wheel 202 several times because such an operation is quite time consuming. Accordingly, under these conditions, the compressed air within the air cylinder 113 is released by opening a cock (not shown) causing the rod 111 of the air cylinder to move downward. Since the slide 98 does not follow, the second connecting rod 96 is pulled downward rotating about the pin 97 as a fulcrum. Simultaneously, the right end of the first connecting rod 94 is also pulled downward together with the pin 95 thereby pulling the pin 93 toward the right as viewed in FIG. 7 and causing the arm 92 to be rotated counterclockwise about the center $0_2'$. Since the counterclockwise rotating motion of arm 92 is opposite in direction to the lefthand (clockwise) rotating motion of the arm previously described in conjunction with the fine adjustment, the first roll shaft 67 is caused to shift in a direction away from the second roll shaft 74. In one embodiment of the invention, the arm 92 is rotated 6° at its central angle by the downward motion of the air cylinder rod 111, which results in a gap of 0.4 mm being created between the first and second paint storage rolls.

Next, referring to FIGS. 7 and 10, the second fine adjusting device for shifting the first and second storage rolls together in the horizontal direction and for finely adjusting the engaging pressure with the painting roll will be described.

Figure 10:
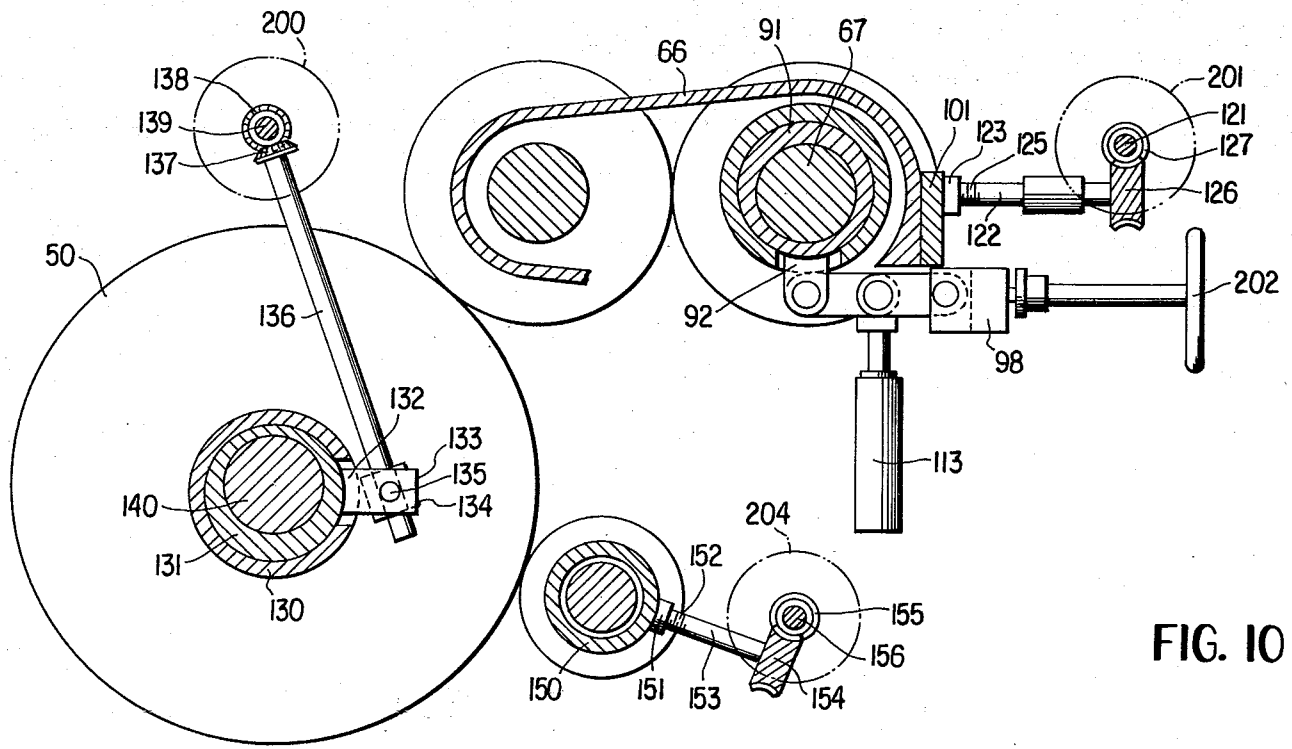
FIG. 10 is a detailed view ilustrating the fine adjusting devices.

FIG. 10 illustrates the first, second, third, fourth and fifth adjusting devices including the already described third fine adjusting device for adjusting the gap between the first and second paint storage rolls and the fourth adjusting device for separating the first paint storage roll from the second paint storage roll in a quick motion. FIG. 10 also shows the first roll shaft 67, the eccentric ring 91, the arm 92, the slide 98, the hand wheel 202 and the air cylinder 113.

The second adjusting device includes a projection 123 (see also FIG. 9) disposed on one end of the support block 101 fixed to the connecting member 66 on the side facing the hand wheel 202, projection 123 having an internally threaded hole 124 (FIG. 9) extending horizontally through its central part. A screw 125 having threads formed in the leading end of a shaft 122 engages threadedly with the threshold hole 124, and a worm wheel 126 is securely fixed on the opposite end of the shaft 122. Worm wheel 126 engages a worm 127 fixed at the leading end of a shaft 121 of the hand wheel 201 (see FIG. 2).

The numeral 120 designates a casing (see FIGS. 2 and 7). The shaft 122 is held immovably in the axial or horizontal direction by a base plate 128 of the casing 120, the shaft 122 being supported so that it can be rotated. When the hand wheel 201 is rotated manually, the worm 127 rotates causing the shaft 122 to be rotated through the worm wheel 126 at a reduced speed. Since the shaft 122 is prevented from shifting in the horizontal direction, the projected element 123 threadedly connected to the threaded part 125 at the leading end of the shaft 122, the support block 101 rigidly connected to the projection 123 and the connecting member 66 are all shifted together. Since the connecting member 66 is securely fixed as a unit to the slides 64, 64' (FIG. 3) which are guided by the pairs of upper and lower guide frames 62, 63 and 62', 63', respectively, the slides 64, 64' are moved together causing the first and second roll shafts 67 and 74 held by these slides to be shifted as a unit in the horizontal direction. Consequently, it is possible to finely adjust the urging pressure created between the painting roll and the second paint storage roll without affecting the relative relationship between the first and second paint storage rolls.

Next, the first fine adjusting device for adjusting the gap between the painting roll and the transport path of the containers will be described.

This device is equipped with an eccentric mechanism similar to that used in the third fine adjusting device for adjusting the gap between the first and second paint storage rolls. In FIG. 10, the numeral 131 designates an eccentric ring disposed between a fixed outer annular member 130 and the shaft 140 of the painting roll 50. An arm 132 is fixedly connected to the shaft 140, arm 132 extending to the right as viewed in the figure and having a bifurcated part 133. A cubic element 134 is held rotatably between the legs of bifurcated part 133 by a pin 135, element 134 pivotally rotating about the pin. An internally threaded hole is provided in the cubic element 134 for engagement with the threads on one end of an elongated rod 136, the opposite end of rod 136 having a driven bevel gear 137 fixed thereto. A driving bevel gear 138 is operatively connected to a hand wheel 200 (see FIG. 2) through a hand wheel shaft 139. When the hand wheel 200 is rotated, the driving bevel gear 138, the driven bevel gear 137 and the elongated rod 136 rotate accordingly causing the cubic element 134 to move upwardly or downwardly along the rod 136 as viewed in the figure thereby rotating the arm 132 connected to the cubic element 134 and hence the ring 131. Consequently, the shaft 140 of the painting roll 50 is shifted in an eccentric motion with respect to the fixed outer annular member 130, and therefore, the gap between the painting roll and the transport path of the can containers is adjusted accordingly.

The fifth fine adjusting device for shifting the scraper roll in order to adjust the gap or urging force between the painting roll and the scraper roll is similar to the arrangement for shifting the first and second paint storage rolls as a unit. Referring more specifically to the upper scraper roll 53, this roll is mounted in position between right and left slides, both slides having a connecting member 150 (see FIG. 10) provided with a projection 151. A connecting rod 153 is connected by threads 152 at one end with the projection 151, and at the opposite end thereof there is provided a worm wheel 154 operatively engaging a worm 155. Rotation of a hand wheel 204 causes the worm 155, the worm wheel 154 and the connecting rod 153 to rotate. The rotating motion of the connecting rod 153 causes the connecting member 150, the slides and the scraper roll 53 mounted on the slides to shift toward or away from the painting roll 50.

Thus, according to the invention, both the upper and lower painting devices are provided with means for individually adjusting the urging forces between each pair of opposed rolls.

When the third fine adjusting device is used to adjust the urging forces between the first and second paint storage rolls, there is a tendency for the first and second paint storage rolls 51 and 52 to come into contact with each other more forcefully at their inner areas 211 (see FIG. 6) than at their outer areas 210. This occurs because there may be play in both the front and rear bearings of the shafts of rolls 51 and 52 and, since the second paint storage roll 52 is in close contact with the painting roll 50 on the side of roll 52 opposite the first paint storage roll 51, the shaft of roll 51 is cantilevered. This results in a smaller contact or urging pressure at the outer areas 210 of rolls 51 and 52 than at their inner areas 211 when the third fine adjusting device is used for shifting the first paint storage roll shaft toward the second paint storage roll shaft. Consequently, an even thickness of paint cannot be applied on the surface of the second paint storage roll, which would result in a different quantity of paint being applied to the upper and lower portions of the cylindrical body surface of the container. Thus, the color shading on the painted can might be so uneven as to require its rejection. To overcome this possible defect, there is provided a sixth fine adjusting device for finely adjusting the first paint storage roll shaft 67 with respect to the second paint storage roll shaft 74 at the rear shaft bearing 69.

Figure 6:
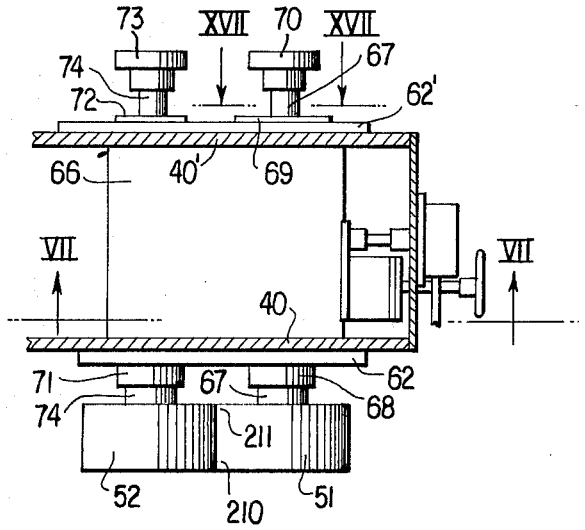
FIG. 6 is a cross-sectional view taken along the line VI—VI in FIG. 5.
Figure 17:
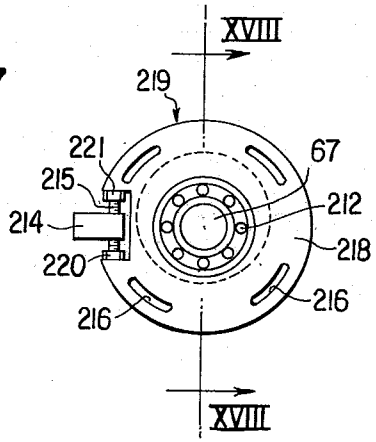
FIG. 17 is a side elevational view showing the fine adjusting device for the first paint storage roll shaft for adjusting the parallelism of contact between the first and second paint storage rolls.
Figure 18:
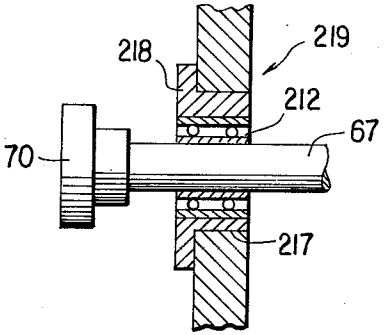
FIG. 18 is a cross-sectional view taken along the line XVIII—XVIII of FIG. 17.

Referring to FIG. 17, which is a fragmentary view in the direction of arrows XVII—XVII in FIG. 6, the sixth fine adjusting device comprises a fine adjusting element 219 surrounding a ball bearing 212 which supports the rear part of the first paint storage roll shaft 67. Element 219 includes a cylindrical part 217 and a flanged part 218 for holding the ball bearing 212 therein, the flanged part 218 being provided with elongated openings 216. The fine adjusting element 219 is formed with a slot 220 in a part of its flanged part 218, in which slot 220 there are disposed an internally threaded element 214 fixedly connected to the slide 64' (FIG. 4) and a threaded rod 215 threadedly engaged with the internal threads of the element 214. Both ends 221 of the threaded rod 215 are maintained in contact with the opposed end surfaces of the slot 220 in such a manner that threaded rod 215 may be rotated. The fine adjusting element 219 is secured to the slide 64' by bolts (not shown) extending through the elongated openings 216. The cylindrical part 217 of the fine adjusting element 219 is inserted rotatably into an opening provided in the slide 64', and the inner circumferential surface of the cylindrical part 217 is eccentric with respect to the outer circumferential surface thereof. When the bolts are loosened and the threaded rod 215 rotated from the outside, the threaded rod 215 can be shifted upward and downward with respect to the fixed internally threaded element 214. The fine adjusting element 219 may then be rotated thereby causing the ball bearing 212 and hence the first paint storage roll shaft 67 to be shifted toward or away from the second paint storage roll shaft 74. Upon completion of this adjusting procedure, the bolts are tightened so that the fine adjusting element 219 is secured to the slide 64'. The sixth fine adjusting operation may be conducted at the same time as the third fine adjusting procedure making it practicable to have a constant urging force exerted by the first and second paint storage rolls over the area between the outer area 210 and the inner area 211 of the first paint storage roll.

Accordingly, both upper and lower painting devices are provided with an individual adjustment of the urging forces between each pair of opposed rolls.

As shown in FIG. 2 the numeral 54 designates the scraping member for the second paint storage roll 52, 55 designates the scraping member for the first paint storage roll 51, and 56 designates the scraping member for the scraper roll 53. Also, the hand wheel 203 permits adjustment of the scraping members 54 and 55, and the hand wheel 205 permits adjustment of the scraping member 56.

The present invention provides apparatus, as shown in FIGS. 11–15, for determining the quantity of paint applied to the cylindrical body surfaces of the can containers by the upper painting device without regard to the operating position of the lower painting roll 350.

Figure 11:
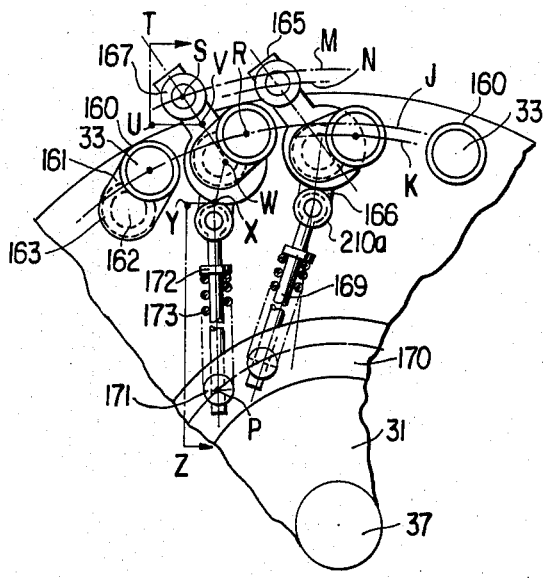
FIG. 11 is a fragmentary front elevational view of a rotatable disc showing details of a mandrel travel path changing means.
Figure 12:
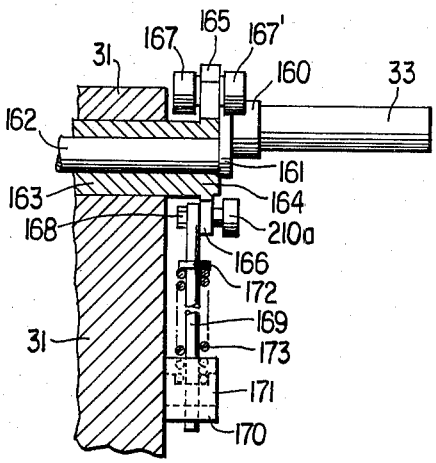
FIG. 12 is a cross-sectional view taken along the line T-U-V-W-X-Y-Z, of FIG. 11.

Referring to FIGS. 11 and 12 together with FIGS. 2 and 3, there is shown the rotable disc 31 mounted on the rotating shaft 37, and the plurality of mandrels 33 disposed adjacent the periphery of the disc 31. Each mandrel 33 is provided with an enlarged base section 160 which is secured to a short rotating shaft 162 through an eccentric plate 161. The axes of the short rotating shaft 162 and the mandrels 33 are parallel and offset with respect to each other. The short rotating shaft 162 is located rotatably inside an eccentric cylinder 163 having its inner and outer surfaces offset with respect to the rotatable disc 31 in a direction perpendicular to the plane of FIG. 12. The eccentric cylinder 163 is provided with an upper arm 165 extending outwardly beyond the rotable disc 31 from a flanged part 164 at the end which supports the mandrel 33, and a lower arm 166 extending generally toward the rotating shaft 37. Cam rolls 167, 167' are mounted rotatably on the upper arm 165, and the lower arm 166 is provided with a change-over bolt 169 which is pivotally suspended from arm 166 by a bolt 168. The lower end of the change-over bolt 169 extends slidably through a spring receiving element 171 which is inserted rotatably within an annular member 170 fixed to the rotatable disc 31. A tension spring 173 is placed between a flange 172 on the change-over bolt 169 and the spring receiving element 171.

As shown in FIGS. 11 and 12, when the center S of the cam roll 167 moves along a circular path M, the center R of the mandrel travels along a circular path J. When the cam roll 167 is forced downwardly by a rocking cam (to be described later) so that its center is located along a circular path N, the eccentric cylinder 163 is caused to rotate under the effect of the downward force thereby causing the short rotating shaft 162 to be displaced with respect to the rotatable disc 31. As a result of the rotating motion of the short rotating shaft 162, the mandrel 33, which is secured in an eccentric position with respect to the short rotating shaft 162, is moved so that its center R is displaced, as shown in FIG. 11, to a position where it moves along the circular path K. Also, movement of the eccentric cylinder 163 causes the lower arm 166 to rotate in a predetermined direction under the tension generated by the spring 173 thereby urging the cam rolls 167, 167' against the rocking cam, which will be described later.

In other words, when the center of the mandrel is on the circular path shown at J, the change-over bolt 169 and the lower arm 166 take a position to the left, as viewed in the figure, of a straight line passing through the center of the outer circular surface of the eccentric cylinder 163 (generally, a point W) and the center P of the spring receiving element 171, thereby producing a force which rotates the eccentric cylinder in the clockwise direction. As a consequence, unless the change-over bolt 169 and the lower arm 166 are shifted to the right of this line by biasing the spring 173 in compression against its tension force, the center of the mandrel 33 continues to travel along the circular path shown at J. When the cam rolls 167, 167' are pushed by the rocking cam so that the change-over bolt 169 and the lower arm 166 are shifted to the right, the center of the mandrel 33 now being along the circular path K, the change-over bolt 169 and the lower arm 166 are caused to move to the right of the straight line passing through the center of the outer circular surface of the eccentric cylinder 163 and the center P of the spring receiving element 171. This generates a spring force which effects a counterclockwise rotating motion of the eccentric cylinder 163 upon the lower arm 166. Once the center of the mandrel is shifted to the circular path K, it continues to travel along that circular path unless the spring 173 is compressed against its tension force so as to produce an external force large enough to cause the change-over bolt and the lower arm to shift to the left as viewed in FIG. 11.

It is advantageous that the apparatus for changing the positions of the mandrels in accordance with the displacement of the cam rolls is simple and positive in its operation and function. Also, the apparatus changes the transport path of the mandrels by employment of a cam plate and a cam roll when a mandrel having no container installed therein is detected so as to avoid contact between the surface of the mandrel and the painting roll. In this case, the mandrel having its center on the circular path K is returned to the circular path J upon contact with a fixed cam plate (to be described later) after passing through the lower painting roll area.

Figure 14:
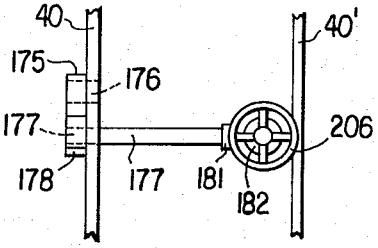
FIG. 14 is a side elevational view of the travel path changing means of FIG. 13.
Figure 15:
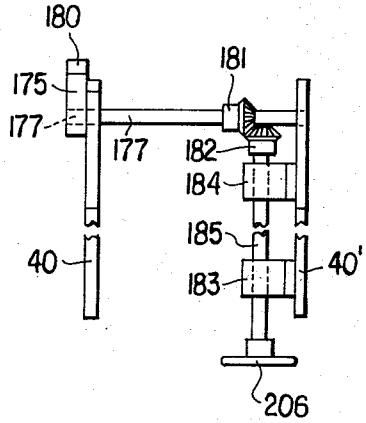
FIG. 15 is a top plan view of FIG. 14.

Next, the device for shifting the cam rolls will be described by reference to FIGS. 13, 14 and 15.

A rocking cam 175 is pivotally connected to the upright plate 40 by a pin 176 disposed in a plane including the transport path of the cam roll 167 and below the upper painting roll 50. The leading end of the rocking cam 175 is biased toward the right as viewed in FIG. 13 by a cam spring 179, and one side of the cam 175 is stopped by an eccentric roll 178 on an eccentric roll shaft 177 mounted rotatably on the upright plates 40, 40', the left side 180 thereof being bifurcated. The eccentric roll shaft 177 has a concentric bevel gear 181 secured thereto, the bevel gear 181 engaging operatively with a bevel gear 182 fixed on the leading end of a shaft 185 of a hand wheel 206 disposed at right angles to the eccentric roll shaft 177. The hand wheel shaft 185 is held by two bearings 183 and 184 secured to the upright plate 40'.

Figure 13:
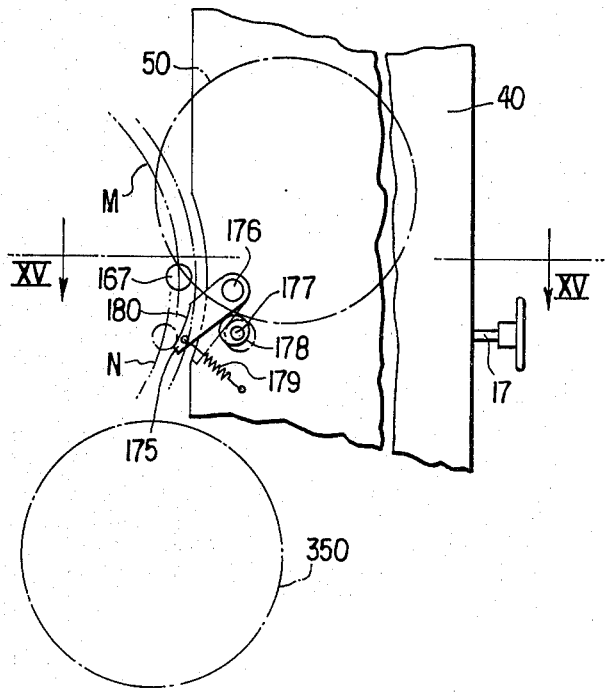
FIG. 13 is a front elevational view showing a cam roll travel path changing means.

In this device, the eccentric roll 178 normally contacts the cam 175 with its smallest eccentric point so that the cam 175 rests in the position shown by the broken line in FIG. 13, the cam positively engaging the eccentric roll 177 under the effect of the tension force exerted by spring 179. The transport path of the mandrels 33 is changed from the normal position by rotating the hand wheel 206 such that the most eccentric point of the eccentric roll 177 comes into contact with the side of cam 175. With this operation, the cam 175 is rocked clockwise against the tension force of the spring 179 to the position shown by the thick line in FIG. 13. At this moment, rotation of the hand wheel is stopped. Then, the left bifurcate part 180 of the cam 175 in the position shown by the thick line in FIG. 13 comes into contact with the approaching cam rolls 167, 167' (see FIGS. 11 and 12) thereby shifting the center of the cam rolls from the circular path M to the circular path N. Consequently, the center of the mandrels 33 now shifts to the circular path K from the circular path J, and the mandrels continue to move detouring away from the lower painting roll 350.

After passing through the area encompassed by the lower painting roll, the cam rolls 167, 167' come into contact with a fixed cam plate, whereby the center of the cam rolls is returned to the circular path M from the circular path N.

Figure 19:
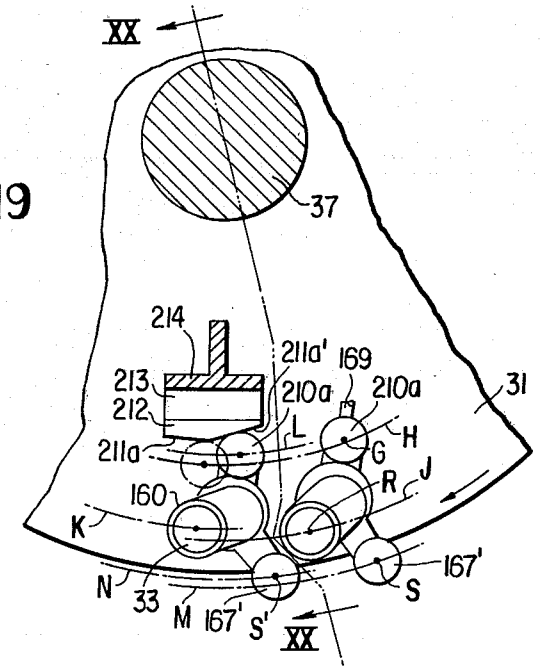
FIG. 19 is a cross-sectional view taken along the line XIX—XIX in FIG. 20 showing a fixed cam plate device for returning the mandrels, whose path has been shifted, to the original path.
Figure 21:
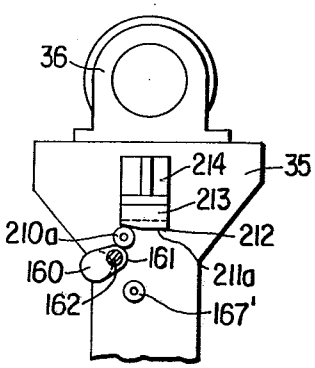
FIG. 21 is a cross-sectional view taken along the line XXI—XXI in FIG. 20.
Figure 20:
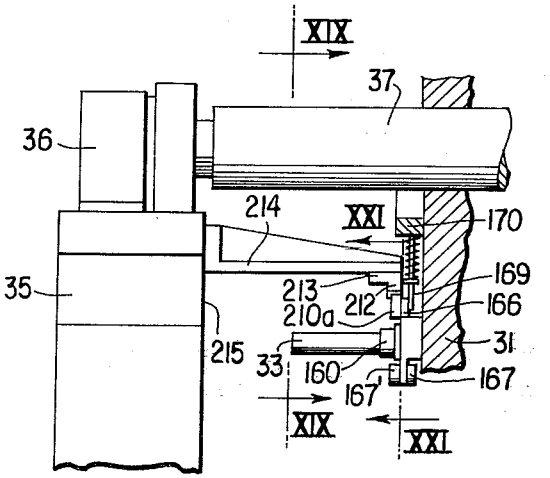
FIG. 20 is a cross-sectional view taken along the line XX—XX in FIG. 19.

The device for returning the center of the cam rolls 167, 167' from the circular path N to the circular path M is next described in conjunction with FIGS. 19, 20 and 21.

In FIGS. 19–21, the numeral **210*a* designates a lower cam roll mounted rotatably on a lower arm 166 depending downwardly from the eccentric cylinder 163 (see FIG. 12). An arm 214 is secured to a surface 215 of the support stand 35 opposite the rotatable disc 31, arm 214 extending horizontally from the support stand 35 toward the rotatable disc. A fixed cam plate 212 is secured to the free end of the arm 214 through an attaching element 213. The fixed cam plate 212 is closer to the shaft 37 of the rotatable disc 31 than the lower cam roll 210***a*, the undersurface of the fixed cam plate 212 contacting the lower cam roll 210*a* when it is displaced to a position where the mandrels do not operatively engage the painting roll 350. The undersurface of the fixed cam plate 212 includes an inclined surface 211*a*' which functions to move the lower cam roll 210*a* away from the shaft 37 and an arcuate surface 211*a* which extends from the inclined surface 211*a* and is concentric with the shaft 37.

In FIG. 19, the circular path K of the center R of the mandrel 33, which is displaced so as not to contact the painting roll, is closer to the shaft 37 than the normal path J of the mandrel center R holding a container thereon and to which paint is to be applied. With respect to the center of the lower cam roll 210*a*, the path of travel L of the center G of the lower roll 210*a* is followed when the containers are located in the position where they do not contact the painting roll; that is, they are closer to the shaft 37 than when they follow the normal path of travel H of the center G when paint is being applied to the containers.

Also, as shown in FIG. 19, as the lower cam roll 210*a* on the circular path of travel L continues to travel in contact with the inclined surface 211*a*' of the fixed cam plate 212, cam roll 210*a* reaches the position shown by the two-dot chain line in FIG. 11, and the center G of the lower cam roll is returned to the circular path H from the original path L. As a consequence, the center R of the mandrels is now returned to the circular path J from the circular path K, and the center of the cam rolls 167, 167' is returned to the circular path M from the circular path N.

The return device, as shown in FIGS. 19–21, is of such construction that it is possible to position the fixed cam plate 212 between the series of mandrels and the horizontal shaft 37. Alternatively, if another device is located between the mandrels and the horizontal shaft 37 so that it is not possible to mount the members as shown in FIGS. 19 and 20, the lower arm may depend from the eccentric cylinder 163 (FIG. 12) on the side of rotary disc 31 on which there are no mandrels. The lower cam roll is attached to the lower arm so that it can provide the fixed cam plate for engagement with the lower cam roll.

In accordance with the invention, the paint is applied by both the upper and lower painting rolls 50 and 350, respectively, thereby permitting better control of the amount of paint applied than is attainable when only a single painting roll is employed. Further, determination of the amount of paint to be applied by the upper painting roll 50 can be made without changing the position of the lower painting roll 350.

More specifically, the quantity of paint applied by the upper painting roll to the containers is measured after disengaging the containers from the lower painting roll, the lower painting roll 350 remaining in its set position. The containers are then returned to the position where they engage the lower painting roll and the total quantity of paint on the containers is measured. The amount of paint applied by the lower painting roll 350 may be determined by subtracting the quantity of paint applied by the upper roll 50 from the total quantity of paint applied to the containers by both rolls.

For the purpose of measuring the amount of paint to be applied by the upper painting roll, if separation is conducted between the lower painting roll and the travel path of the mandrels by changing the location of the lower painting roll, which separation is not according to the present invention, it is necessary to accomplish it by manually turning a hand wheel which controls the fine adjusting device through several revolutions in order to shift the position of the lower painting roll, an operation which requires substantial labor and time. Further, even if the hand wheel is turned back to its original position after being turned several times to adjust the position of the lower painting roll, it is not always possible to return the roll to its original position because of the normal play in the gears. Consequently, there will be a small amount of deviation in the adjustment of the roll.

The container painting apparatus according to this invention does not require the above-mentioned labor and time, and application of paint by the upper and lower painting rolls can be carried out as soon as the upper painting roll has been adjusted because the rolls remain in their original respective positions immediately after determination of the quantity of paint to be applied by the upper painting roll 50.

Further, the container painting apparatus of this invention is provided with a device for decreasing the relative travel speed of the mandrels driven by engagement with the painting roll during the painting step. That is, the rotating velocity of the mandrels is decreased substantially to zero to permit the painted containers to be readily removed from the mandrels.

Figure 16:
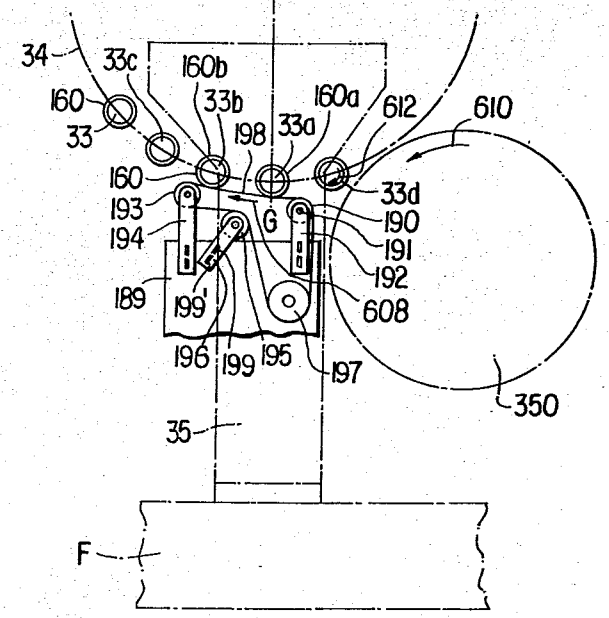
FIG. 16 is a side elevational view showing a belt arrangement disposed below a lower painting roll in contact with an enlarged base section of the mandrel.

This device is shown in FIG. 16, in which the two-dot chain lines show the lower painting roll 350, the support stand 35 for the bearing of the rotable disc 31, the base plate F and the travel path 34 of the series of mandrels 33 mounted on the disc 31. A mandrel 33*a* is located at the lowest position on disc 31 and on the vertical center line G-G of disc 31. Other mandrels 33*b*, 33*c* are positioned at equal intervals along the rotational travel path 34 of disc 31 to the left of line G-G and another mandrel 33*d* is located to the right of this line along the same path. An endless belt 198 extends adjacent the middle portion of the enlarged base section 160 of the mandrels in such a manner that the belt is in contact with the base sections 160*a* and 160*b* of mandrels 33*a* and 33*b* and extends at its extremity just beyond these mandrels.

The belt 198 is stretched across a first driven pulley 190, a second driven pulley 193 and a driving pulley 197, its tension being adjusted by a tension pulley 195. The first driven pulley 190 is held rotatably by a pin 191, this pin being secured to a first support plate 192. The second driven pulley 193 is held in the same way as the pulley 190 by a second support plate 194 and an associated pin. The first and second support plates 192 and 194 are secured to a mounting plate 189. The tension pulley 195 is also held in position by a pin and a third support plate 196, the third support plate 196 being attached to the mounting plate 189 in such a manner that it may adjustably be shifted in the direction generally perpendicular to a straight line passing through the centers of the second driven pulley 193 and the driving pulley 197. More specifically, two elongated openings 199 and 199' are provided in the third support plate 196 so that plate 196 and hence the tension pulley 195 may be adjusted. Alternatively, other known means for displacing tension pulley 195 may be employed.

It is preferable that elongated openings be provided in the mounting parts of the first and second support plates 192,194 for the first and second driven pulleys 190,193 so as to permit adjustment of the engaging force between the enlarged base sections of the mandrels and the belt. In the embodiment shown in FIG. 16, there are two elongated openings provided in each of the support plates.

The driving pulley 197 is driven by suitable driving means (not shown), the travel of the endless belt 198 being directed from the first driven pulley 190 to the second driven pulley 193 as shown by arrow 608. Since the painting roll 350 rotates counterclockwise as indicated by arrow 610, each of the mandrels is rotated clockwise as shown by arrow 612. The endless belt progresses in the same direction as the mandrels, and at a velocity which is approximately equal to the linear velocity at the outer surfaces of the enlarged base sections of the mandrels. Consequently, each of the mandrels rotating on its own axis during its travel is caused to substantially stop its own rotation upon contact with belt 198. This is advantageous because it is much easier to remove a container from a mandrel which is not rotating than from a mandrel which is rotating on its own axis.

Summarizing, the present invention provides the following advantages:

(1) Since two sets of painting devices are employed at the upper and lower stages of the apparatus, the painting roll may be rotated at half the number of revolutions per unit time as would be required if only one painting device were employed to apply a given quantity of paint to a predetermined number of containers in a given period of time. Consequently, the tendency for the paint to be slung or spun away from the surface of the painting roll is minimized.

(2) Since the first and second paint storage rolls have their axes of rotation in a horizontal plane in each of the painting devices, and since each set of paint storage rolls is disposed at a diagonally higher level than the painting roll, the size of the entire painting apparatus is similar to that of an apparatus incorporating a single painting device. Consequently, the advantages of two painting rolls are realized without a significant increase in the area and volume of the installation. Also, since the speeds of rotation of the painting roll, first paint storage roll and second paint storage roll in each of the painting devices are independently adjustable, the number of containers which can be handled in a given period of time may be varied over a wide range.

(3) The transport path of the series of containers can be shifted so that they do not contact the lower painting roll. Consequently, it is possible to measure the quantity of paint applied only by the upper painting roll without moving the lower painting roll away from the rotatable disc 31. Thereafter, by returning the transport path of the containers to the normal painting position where the containers contact the lower painting roll and by measuring the total quantity of paint applied to the finished containers by both the upper and lower painting rolls, the quantity of paint applied only by the lower painting roll can be measured.

(4) When it is desired to change the quantity of paint applied by the upper painting roll alone without changing the quantity of paint applied by the lower painting roll, if the quantity of paint applied by the upper painting roll alone is measured after the lower painting roll is withdrawn from the travel path of the mandrels, it is necessary to set the quantity of paint to be applied by the upper painting roll to a desired level and then return the lower painting roll to its original position. However, it is difficult to exactly return the lower painting roll to the original position after it has been shifted. Therefore, it is necessary to measure the total quantity of paint applied by both the upper and lower painting rolls and then adjust the location of the lower painting roll so that the total quantity of paint will reach the desired value.

According to this invention, since the quantity of paint to be applied by the upper painting roll may be measured without affecting the operating position of the lower painting roll, it is only necessary to preset the quantity of paint to be applied by the upper painting roll alone at a desired level, thereby assuring that the desired total quantity of paint will be applied by both the upper and lower painting rolls.

(5) The quantity of paint applied by each of the painting devices may be readily and precisely adjusted by means of the individual fine adjusting devices for adjusting each of the engaging pressures between the containers and the painting roll, between the painting roll and the pair of first and second paint storage rolls and between the first and second paint storage rolls.

(6) Any deviation in parallelism between the outer surfaces of the first and second paint storage rolls may be corrected by a fine adjustment device to assure that an even thickness of paint is applied to the second paint storage roll.

(7) The first and second paint storage rolls, may be quickly separated. This is important in an emergency in which paint is no longer being supplied between the two paint storage rolls thereby presenting the possibility of damage to the painting roll.

(8) Rotation of the mandrels on their axes may be substantially stopped while removing the finished containers from the mandrels thereby facilitating their manual removal.

It will be understood that the above description of the present invention is susceptible to various modifications, changes and adaptations, and the same are intended to be comprehended within the meaning and range of equivalents of the appended claims.

What is claimed:

1. Apparatus for painting the outer circumferential surfaces of a plurality of cylindrical containers, comprising a rotatable disc having a surface positioned in a vertical plane, said rotatable disc being rotatable about an axis lying in a horizontal plane;

a plurality of equally spaced rotatable mandrels secured to the surface of said disc along a concentric circle adjacent the periphery thereof and projecting horizontally therefrom, each of said mandrels following a predetermined path and being adapted to releasably support a cylindrical container;

a rotatable painting roll having a horizontal axis of rotation displaced vertically from said horizontal plane and positioned adjacent said disc, said painting roll being urged into close contact with the containers supported on said mandrels for painting said containers as said mandrels traverse said predetermined travel path;

a first rotatable paint storage roll, including a shaft, having a horizontal axis of rotation;

a second rotatable paint storage roll having a horizontal axis of rotation located above the horizontal axis of rotation of said painting roll, said second paint storage roll being interposed between said painting roll and said first paint storage roll, the axes of rotation of said first and second paint storage rolls being parallel and defining a horizontal plane, and the axis of rotation of said painting roll and said second paint storage roll being parallel and defining a plane which is angularly displaced with respect to said horizontal and vertical planes;

a second rotatable painting roll positioned in the direction of rotation of said disc from said first rotatable painting roll; and means for displacing the predetermined path of said mandrels away from said second painting roll in the region between said first and second painting rolls.

2. Apparatus as defined by claim 1 which further comprises a gear box, and wherein each of said painting roll, first paint storage roll and second paint storage roll have respective shafts coupled to said gear box.

3. Apparatus as defined by claim 1 which further comprises a plurality of fine adjustment means, and wherein said first and second paint storage rolls are provided with respective shafts, including a first fine adjustment means for adjusting the distance between said painting roll and the predetermined path of travel of the mandrels supporting said containers;

a second fine adjustment means for adjusting the distance between said second paint storage roll and said painting roll;

a third fine adjustment means for adjusting the distance between said first and second paint storage rolls; and a fourth fine adjustment means for adjusting the shafts of said first and second paint storage rolls to attain parallelism between the outer circumferential surface of said first and second paint storage rolls when they are displaced with respect to each other.

4. Apparatus as defined by claim 3 wherein the shafts of said first and second paint storage rolls are mounted in displaceable bearings, and wherein said fourth fine adjustment means adjusts the relative positions of said bearings to attain parallelism between the outer circumferential surface of said first and second paint storage rolls.

5. Apparatus as defined by claim 3 which further comprises a quick adjustment means for quickly separating said first and second paint storage rolls from each other in a rapid motion.

6. Apparatus as defined by claim 1, 3 or 5 wherein each of said rotatable mandrels has an enlarged base portion adjacent said rotatable disc, and which further comprises belt means positioned adjacent said mandrels in a location displaced from said rotatable painting roll in the direction of rotation of said disc, said belt means contacting the enlarged portion of said mandrel and being translated at a speed approximately equal to the peripheral speed of the enlarged portion of said mandrel.

7. Apparatus as defined by claim 1 wherein said means for displacing the predetermined path of said mandrels away from said second painting roll comprises:

an eccentric cylinder mounted on said disc;

a short rotatable shaft, said shaft being integral with said mandrel and surrounded by said eccentric cylinder;

a cam roll mounted on said eccentric cylinder;

a change-over bolt, one end of said bolt being pivotally connected to said eccentric cylinder and the other end thereof being pivotally connected to the surface of said disc;

a tension spring surrounding said change-over bolt; and a rocking cam pivotally connected to an upright frame and biased by a cam spring toward the outside of the predetermined path of said mandrels, whereby said rocking cam is moved into contact with said cam roll by the rocking of said cam against the force of said cam spring, rotation of said eccentric cylinder being caused against the tension force of said tension spring thereby displacing the predetermined path of said mandrels away from said second painting roll.

8. Apparatus as defined by claim 1 which further comprises a fine adjustment means for obtaining parallelism between the outer circumferential surface of said first and second paint storage rolls wherein one end of the shaft of said first paint storage roll is mounted in a displaceable bearing.

9. Apparatus as defined by claim 1 which further comprises a quick adjustment means for quickly separating said first and said second paint storage rolls from each other.

10. Apparatus as defined by claim 1 which further comprises an eccentric ring surrounding the shaft of said first paint storage roll;

a fixed outer annular member surrounding said eccentric ring;

a cylinder containing fluid and having a piston rod; and linkage means connecting said piston rod to said eccentric ring, whereby said first paint storage roll is quickly separated from said second paint storage roll when fluid is suddenly released from said cylinder.

11. Apparatus as defined by claim 9 wherein said quick adjustment means comprises an eccentric ring surrounding the shaft of said first paint storage roll;

a fixed outer annular member surrounding said eccentric ring;

a cylinder containing fluid and having a piston rod; and linkage means connecting said piston rod to said eccentric ring, whereby said first paint storage roll is quickly separated from said second paint storage roll when fluid is suddenly released from said cylinder.

* * * * *